US006922951B1

(12) United States Patent
Inzeo et al.

(10) Patent No.: US 6,922,951 B1
(45) Date of Patent: Aug. 2, 2005

(54) LIGHTED ROOF EDGE ASSEMBLY

(75) Inventors: Joseph A. Inzeo, West Allis, WI (US); Scott A. Kittilstad, Waukesha, WI (US)

(73) Assignee: Metal-Era, Inc., Waukesha, WI (US)

( * ) Notice: Subject to any disclaimer, the term of this patent is extended or adjusted under 35 U.S.C. 154(b) by 0 days.

(21) Appl. No.: 10/345,729

(22) Filed: Jan. 16, 2003

(51) Int. Cl.[7] ..... E04B 7/00
(52) U.S. Cl. ..... 52/94; 52/60
(58) Field of Search ..... 52/58, 60, 300, 52/94; 362/151, 576, 145, 147, 152, 559

(56) References Cited

U.S. PATENT DOCUMENTS

| | | | | |
|---|---|---|---|---|
| 3,984,951 | A * | 10/1976 | Hindman | 52/91.3 |
| 4,800,689 | A * | 1/1989 | Lane | 52/60 |
| 4,897,973 | A * | 2/1990 | Foster et al. | 52/102 |
| 4,901,492 | A | 2/1990 | Coates | |
| 4,974,128 | A * | 11/1990 | Prickett | 362/145 |
| 5,107,551 | A | 4/1992 | Weir et al. | |
| 5,134,819 | A | 8/1992 | Boyack | |
| 5,170,517 | A | 12/1992 | Stegmeier | |
| 5,544,028 | A | 8/1996 | Carlin | |
| 5,680,730 | A | 10/1997 | Epple | |
| 5,915,848 | A | 6/1999 | Deason | |
| 6,039,458 | A | 3/2000 | Coates, Jr. et al. | |
| 6,050,703 | A | 4/2000 | Herbert | |
| 6,179,440 | B1 | 1/2001 | Palmer | |
| 6,199,223 | B1 | 3/2001 | Sorokin | |
| 6,640,508 | B2 * | 11/2003 | Lindgren et al. | 52/200 |
| 6,751,911 | B1 * | 6/2004 | Gates et al. | 52/96 |

* cited by examiner

*Primary Examiner*—Peter M. Cuomo
*Assistant Examiner*—Stephen Vu
(74) *Attorney, Agent, or Firm*—Boyle Fredrickson Newholm Stein & Gratz S.C.

(57) ABSTRACT

A lighted roof edge assembly is provided. The roof edge assembly can be formed as a conventional coping or fascia assembly that includes a cover plate attachable to a roof edge through the use of an anchor member secured to the roof edge. The cover plate includes a channel in which is disposed a retainer. The retainer is releasably engageable with a lighting element that can be selectively switched on to illuminate the area of the structure to which the assembly is attached directly around the assembly.

20 Claims, 3 Drawing Sheets

FIG. 2
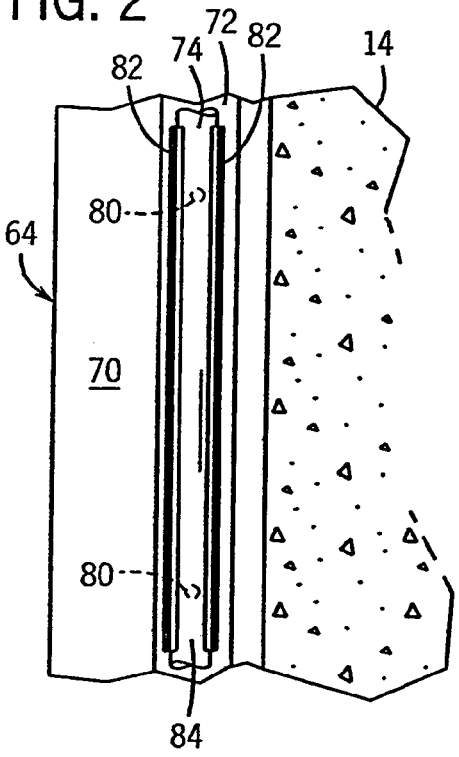
FIG. 4
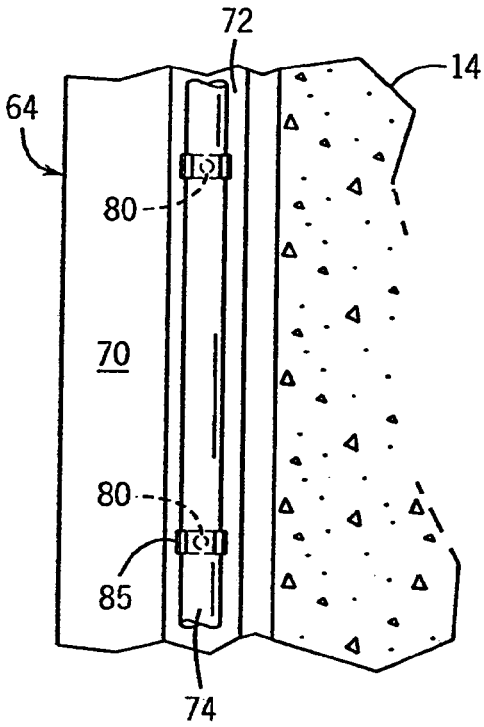
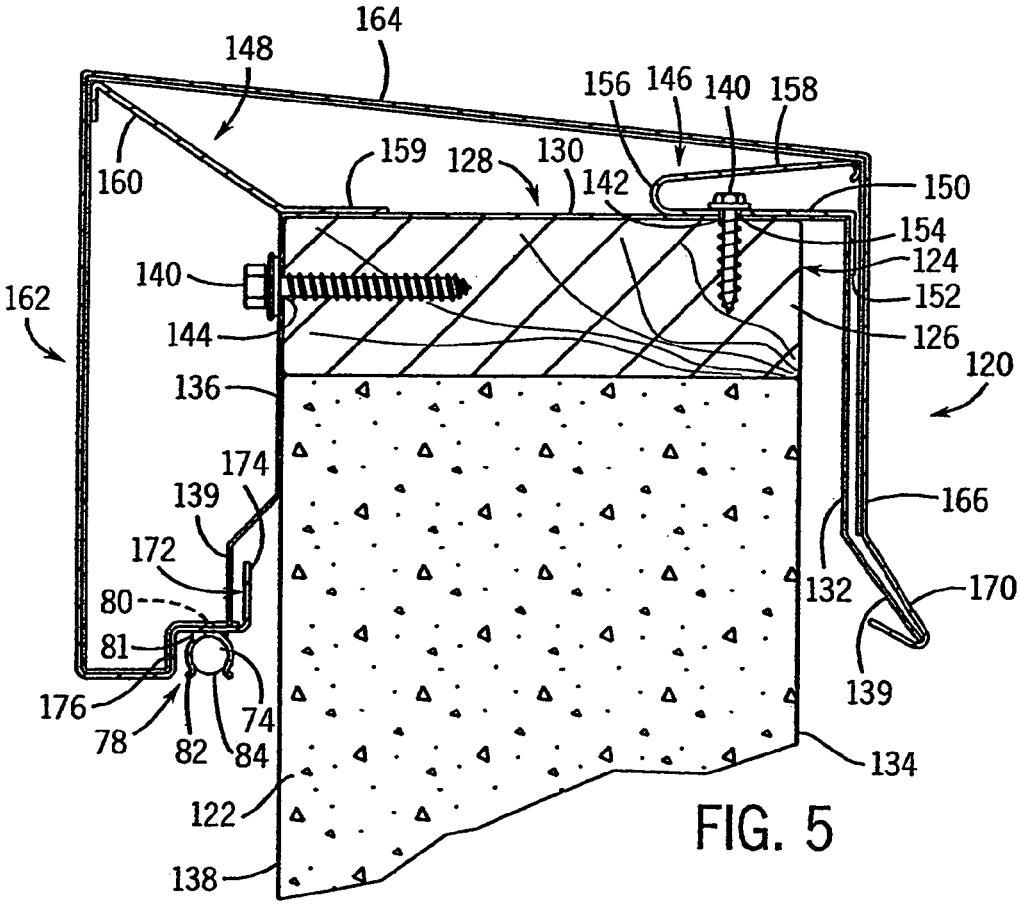
FIG. 5

LIGHTED ROOF EDGE ASSEMBLY

FIELD OF THE INVENTION

The present invention relates to roof edge assemblies, and more specifically to a coping or fascia assembly incorporating a lighting element.

BACKGROUND OF THE INVENTION

Numerous coping and fascia assemblies have been developed to effectively seal and/or waterproof the roofs of buildings, while providing an aesthetically pleasing appearance along the edge of the roof. However, with prior art fascia and coping assemblies, the aesthetic appearance that can be provided by the assembly is limited to the colors and/or structural appearance of these assemblies. More specifically, because the majority of prior art fascia and coping assemblies are focused on preventing the entry of water beneath a roofing membrane positioned on the roof, any advancements in the appearance of the coping and fascia assemblies have been necessarily limited to slight improvements in the structural appearance of or the colors of the members forming the coping or fascia assemblies which do not affect the ability of the assembly to function properly.

Therefore, it is desirable to develop a roof edge assembly that includes features giving the assembly an enhanced aesthetic appearance in addition to simply the appearance of the assembly. It is also desirable to incorporate the aesthetically pleasing features or components into the roof edge assembly to provide benefits to the assembly other than simply making the assembly more aesthetically pleasing, such as components that also provide a safety feature to the building or structure utilizing the assembly. Also, the added feature should not detract from the functionality of the assembly to waterproof a roof.

SUMMARY OF THE INVENTION

It is an object of the present invention to provide a roof edge assembly having a generally conventional construction and also including a lighting element attached to the roof edging assembly.

It is a further object of the invention to provide a roof edge assembly in which the lighting element can be releasably secured to the assembly so that the lighting element can be easily removed and replaced, such as if the element becomes damaged.

It is still another object of the present invention to provide a roof edge assembly including the lighting element in which the assembly can be configured as a fascia or as a coping.

The present invention is a roof edge assembly that includes a lighting element releasably secured to the roof edge assembly. The roof edge assembly can be used to provide a waterproof seal around the periphery of a roofing membrane positioned over the roof and can take the form of a conventional fascia or coping assembly. In either form, the roof edge assembly includes an anchor clip fixed to a nailer disposed on the top of the roof edge and over which the roofing membrane is positioned. The anchor clip is configured as necessary to accommodate the remaining pieces of the fascia or coping forming the roof edge assembly with the anchor depending upon the particular configuration for the roof edge assembly.

Among these remaining pieces, the roof edge assembly also includes a cover plate secured to the anchor clip in order to provide the structural aesthetic appearance for the roof edge assembly. In both types of roof edge assemblies, the cover plate includes a recessed channel formed on the exterior of the cover plate and spaced from the front of the cover plate in which the lighting element can be mounted. The lighting element is received within one or more securing members located within the channel on the cover plate. The securing members are configured to receive the lighting element therein such that the light emitted from the lighting element can be emitted in a desired direction from the roof edge assembly while the lighting element is concealed behind the cover plate within the channel.

Various other features, objects and advantages of the present invention will be made apparent from the following detailed description taken together with the drawing figures.

BRIEF DESCRIPTION OF THE DRAWINGS

The drawings illustrate the best mode currently contemplated of practicing the present invention.

In the drawings:

FIG. 2 is a cross-sectional view along line 2—2 of FIG. 1;

FIG. 4 is a cross-sectional view along line 4—4 of FIG. 3; and

FIG. 5 is a cross-sectional view of a third embodiment of the roof-edge assembly of FIG. 1.

DETAILED DESCRIPTION OF THE DRAWINGS

Figure 1:
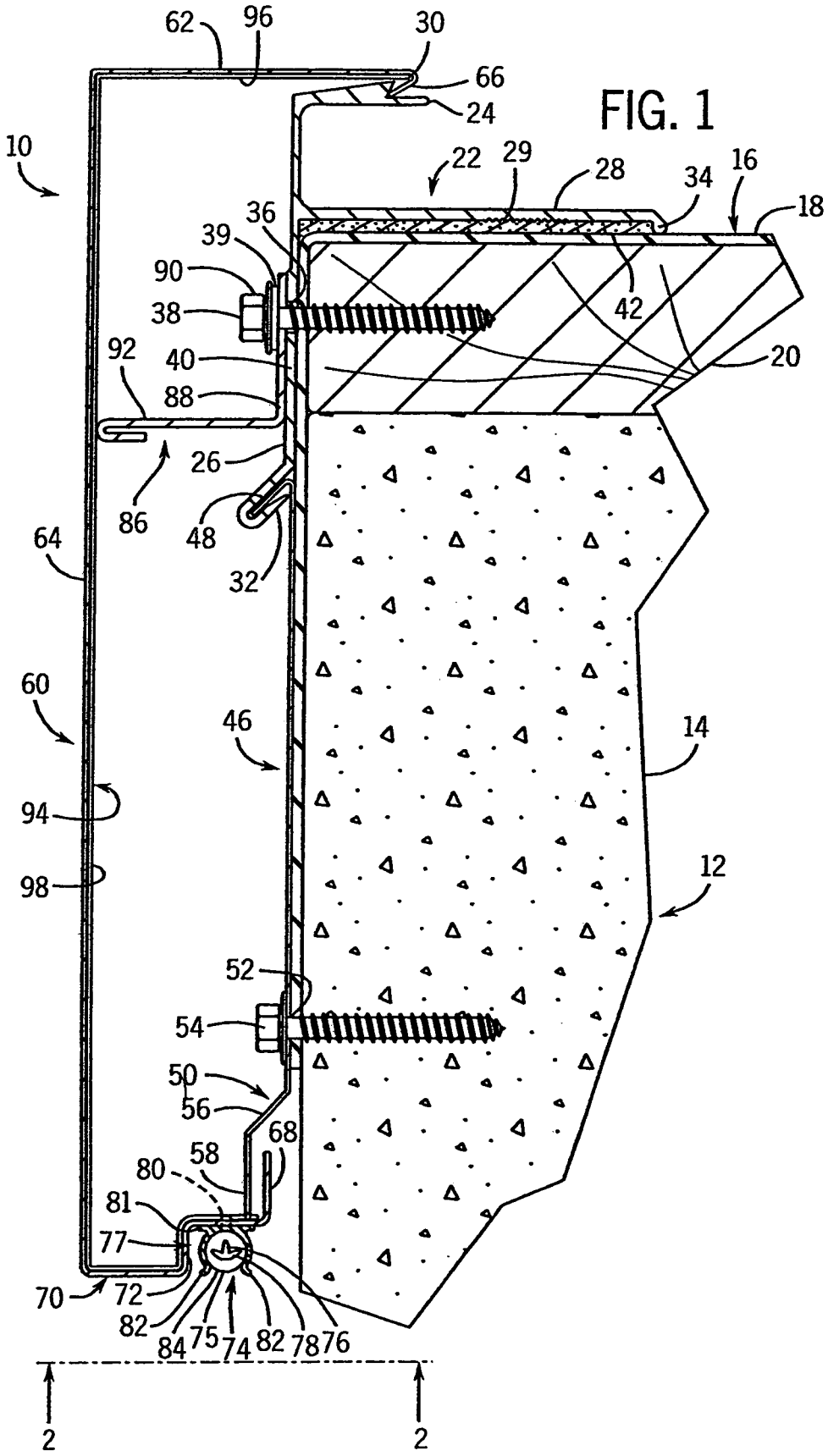
FIG. 1 is a cross-sectional view of a fascia assembly including a lighting element constructed according to the present invention.

With reference now to the drawing figures in which like-reference numerals designate like parts throughout the disclosure, the roof edge system of the present invention is illustrated generally at 10 in FIG. 1. The system 10 is similar to that disclosed in commonly-owned and co-pending U.S. patent application Ser. No. 10/277,552, which is herein incorporated by reference in its entirety, and is secured to a building 12 having a number of side walls 14 and a roof 16. The system 10 is designed to be secured to the building 12 at the intersection or joining of the walls 14 and the roof 16 in order to provide a more aesthetically pleasing appearance to the exterior of the building 12.

As best shown in FIGS. 1 and 2, in a first embodiment the system 10 is attached to the building 12 over a roofing membrane 18 that covers the roof 16 and extends upwardly from the roof 16 over a conventional wooden nailer 20 positioned on top of each of the walls 14. The membrane 18 extends over the nailer 20 and downwardly to cover the uppermost portion of each of the walls 14 and provide a waterproof layer over the entire surface of the roof 16 of the building 12. Further, in some roof constructions, there is also a flashing strip (not shown) and/or base sheet (not shown) used in conjunction with the membrane 18.

The edging system 10 includes an anchor bar 22 formed of a rigid material, preferably metal, and most preferably aluminum. The anchor bar 22 is formed as an elongate generally rectangular member having an engagement portion 24 extending perpendicularly from one end of the anchor bar 22, a locking flange 26 extending outwardly from the anchor bar 22 opposite the engagement portion 24, and a sealing flange 28 extending perpendicularly from the anchor bar 22 parallel to the engagement portion 24 and spaced between the locking flange 26 and engagement portion 24. The engagement portion 24 is integrally formed with the anchor bar 22 and includes a longitudinal groove 30 extending the length of the engagement portion 24. The locking flange 26 is also integrally formed with the anchor bar 22 and is formed by shaping the part of the anchor bar 22 opposite the engagement portion 24 into a generally U-shaped configuration to define a longitudinal slot 32 between opposite halves of the locking flange 26.

The sealing flange 28 is also integrally formed with the anchor bar 22 similarly to the engaged portion 24 and includes a downwardly extending bead 34 disposed on the sealing flange 28 opposite the anchor bar 22. The flange 28 also preferably includes a serrated section 29 disposed on the flange 28 opposite the engagement portion 24.

To secure the bar 22 to the wall 14, the anchor bar 22 includes a number of apertures 36 extending through the anchor bar 22 and disposed between the locking flange 26 and sealing flange 28. Each of the apertures 36 is adapted to receive a fastener 38 including a washer 39, such as a clip, a nail, a wood/metal screw, or other suitable mechanical fastener therethrough which penetrates into the nailer 20 to secure the anchor bar 22 to the building 12. The portion 40 of the anchor bar 22 in which the apertures 36 are disposed may also be thickened to provide additional strength to the anchor bar 22 in the region where the anchor bar 22 is secured by the fasteners 38 to the building 12.

When the bar 22 is secured to the building 12, in order to provide a waterproof seal around the periphery of the roof 16 of the building 12, the anchor bar 22 is positioned over the roofing membrane 18 on the nailer 20 such that the connection of the anchor bar 22 to the nailer 20 also fixes the roofing membrane 18 over the nailer 20. However, in order to provide an enhanced waterproof seal between the roofing membrane 18 and the nailer 20 and anchor bar 22, an amount of a sealant 42 is positioned on the serrated portion 29 of the sealing flange 28 such that when the anchor bar 22 is engaged with the roofing membrane 18, the sealant 42 contacts and spreads along the portion of the membrane 18 disposed beneath the sealing flange 28. Depending on the amount of sealant 42 utilized, the sealant 42 is prevented from squeezing out of the space between the sealing flange 28 and the membrane 18 by the presence of the bead 34 on the far end of the sealing flange 28.

The anchor bar 22 can be formed in any necessary configuration to fit the particular curvature or design of a roof 16 such that the edging system 10 can be utilized with buildings 12 having various shapes. For example, the anchor bar 22 can be formed as a single flat bar, or can be bent or formed into a right angle shape in order to form an outside miter (not shown) for use on the corner of a building 12. Further, while also not shown in the drawings, the anchor bar 22 can be formed to have an opposite right angled shape to form an inside miter, or can be curved to conform to a curved section of a roof 16 of a building 12, among other possible shapes.

Figure 3:
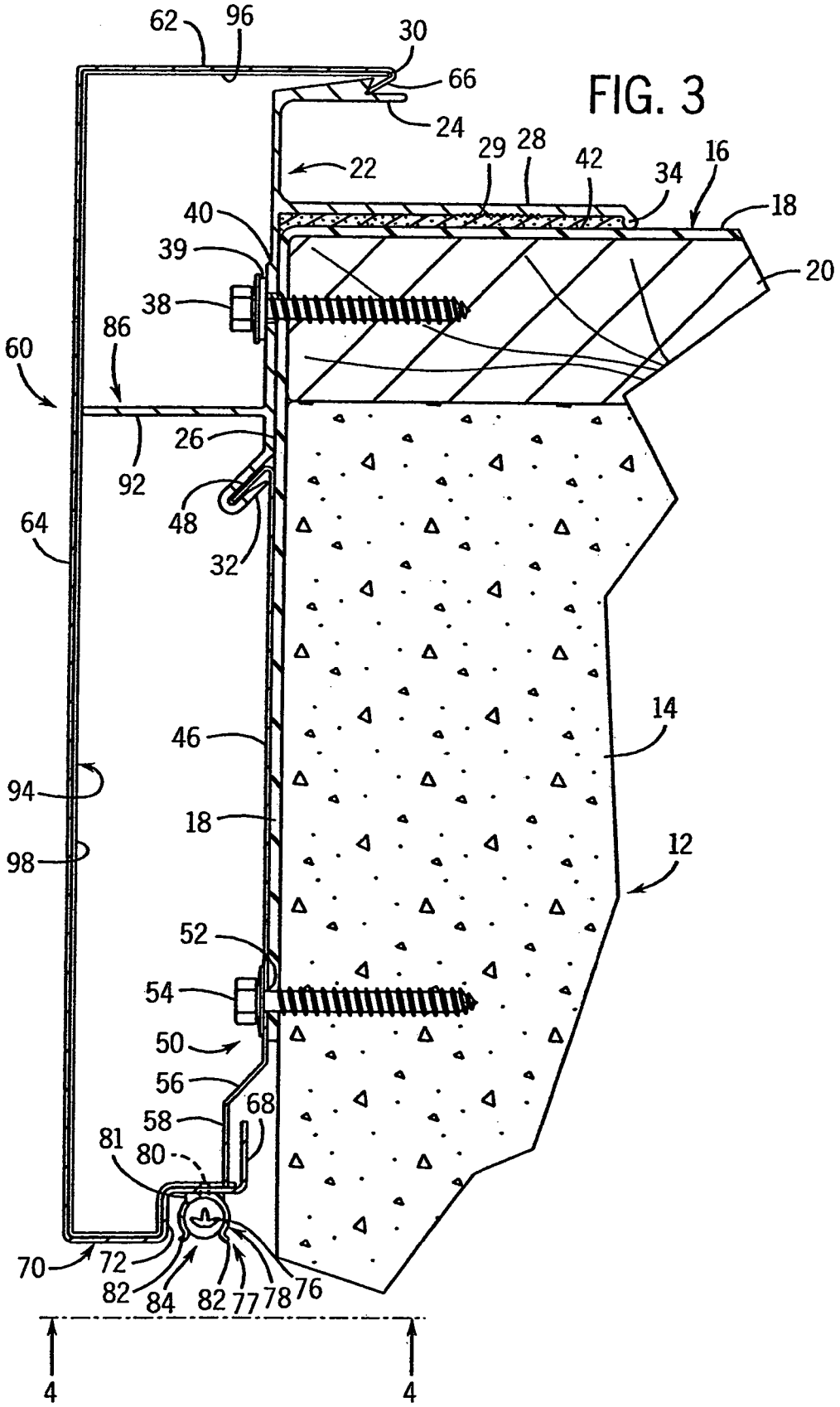
FIG. 3 is a cross-sectional view similar to FIG. 1 illustrating a second embodiment of the roof edge assembly of FIG. 1.

The edging system 10 also includes an anchor cleat 46. The anchor cleat 46 is formed of a semi-rigid material, such as a thin metal, and includes a locking tab 48 at one end. The tab 48 extends longitudinally the entire length of the anchor cleat 46 and is shaped complimentary to the locking flange 26 such that the anchor cleat 46 can be securely but releasably engaged with the anchor bar 22 by the insertion of the locking tab 48 into the locking flange 26. Preferably, the locking flange 26 is angled outwardly from the anchor bar 22 as shown in FIGS. 1 and 3 such that when the locking tab 48 is inserted within the locking flange 26 and the bar 22 is secured to the wall 14, it is impossible to remove the tab 48 from within the locking flange 26 without first detaching the anchor bar 22 from the wall 14.

Opposite the locking tab 48, the anchor cleat 46 also includes an engagement end 50 and a number of metal/wood apertures 52 spaced adjacent the securing end 50. The apertures 52 receive fasteners 54, such as screws, which, similar to the fasteners 38, are used to fix the anchor cleat 46 to the walls 14 of the building 12. Also, the securing end 50 is preferably formed with an angled portion 56 extending outwardly from the anchor cleat 46 immediately adjacent the apertures 52, and a flat portion 58 extending parallel to the remainder of the anchor cleat 46 from the end of the angled portion 56. The length and angle of the angled portion 56 is chosen to position the securing end 50 at a location essentially coplanar with the outermost point of the locking flange 26 to enable the remaining components of the system 10 to be secured parallel to the anchor bar 22 and anchor cleat 46.

Further, the width of the anchor cleat 46 between the angled portion 56 and the locking tab 48 can be varied as necessary, such that the anchor bar 22 and cleat 46 can be varied in overall length to accommodate different sizes for the remaining components utilized in the roof edging system 10. However, regardless of the size of the cleat 46, the anchor cleat 46 retains the locking tab 48 at one end and the securing end 50 and apertures 52 at the opposite end such that the anchor cleat 46 can be engaged with the anchor bar 22 and fixed to the building 12 in the manner described above. Also, similarly to the previous discussion regarding the anchor bar 22, the anchor cleat 46 can be shaped to have forms complimentary to the shape of the walls 14 and the anchor bar 22, such as the right angle shape for the anchor bar miter discussed previously.

To cover the anchor bar 22 and anchor cleat 46 after they are secured to the building 12 and provide an aesthetically pleasing appearance to the system 10, the roof edge assembly 10 also includes a cover plate 60. The cover plate 60 is a generally elongate member that is L-shaped in cross section, including a narrow elongate section 62 joined at one end to a wide elongate section 64. The narrow section 62 includes a locking tab 66 disposed opposite the wide section 64 that extends the length of the narrow section 62 and is dimensioned to engage the groove 30 disposed along the engagement portion 24 of the anchor bar 22.

The narrow section 62 and wide section 64 are integrally formed with one another from a piece of a suitable generally rigid material, such as a metal, that has a thickness from 0.75 mm to 2.50 mm, and preferably between 1.10 mm and 1.80 mm. The cover plates 60 are shaped to conform to the shapes of the anchor bar 22 and anchor cleat 46, such as by forming an exterior cover plate miter (not shown). Also, to enhance the appearance of the system 10, the cover plate 60 can be painted, or have other decorative material (not shown) placed on the wide section 64 opposite the anchor bar 22 and anchor cleat 46.

The length of the wide section 64 of the cover plate 60 can vary as necessary to provide the appropriate coverage for the edging system 10 on the building 12, which most times depends on the size of the building 12 and the amount of coverage desired from the system 10. When the wide section 64 of the cover plate 60 is lengthened, the edging system 10 can accommodate this length by utilizing an anchor cleat 46 having a length capable of increasing the overall length of the anchor bar 22 and anchor cleat 46 to securely engage the cover plate 60 and provide the pleasing aesthetic appearance for the building 12. In a preferred embodiment, the system 10 includes cover plates 60 and anchor cleats 46 having the appropriate size for the cover plates 60, but the anchor cleats 46 may also be formed into the desired configuration on the jobsite as well.

Opposite the narrow section 62, the wide section 64 also includes an engagement flange 68 that is adapted to be positioned around the securing end 50 of the anchor cleat 46. The engagement flange 68 is disposed on one end of a bottom section 70 formed on the cover plate 60 opposite the narrow section 62. The bottom section 70 defines a recess or channel 72 between the wide section 64 and the engagement flange 68 in which can be attached a lighting element 74. The lighting element 74 is secured within the channel 72 by a securing member 76 positioned within the channel 72 and adapted to releasably engage the lighting element 74. In a preferred embodiment, the lighting element 74 is a light rope, such as that manufactured and sold by Wide Loyal Development, Ltd. of British Columbia, Canada, under the trade name Flexilight and including a flexible exterior sheath 75 containing a light string 77 therein.

The securing member 76 used to secure the lighting element 74 within the channel 72 is preferably a sleeve 78 fixedly secured within the channel 72 by a number of fasteners 80. The sleeve 78 is formed of a somewhat flexible or resilient material, such as a plastic or thin metal. The sleeve 78 is generally circular in cross section, and includes a base 81 positioned against the channel 72 and a pair of arms 82 extending outwardly from opposite sides of the base 81 that define an open end 84 therebetween for the sleeve 78. The lighting element 74 can be pressed between the arms 82 and held therein due to the resiliency of the material forming the sleeve 78. Alternatively, in a second embodiment, the lighting element 74 can be held in position by a number of brackets 85 attached to the channel 72 by the fasteners 80 as best shown in FIGS. 3 and 4, or other suitable securing members, such as a tie strip or an adhesive.

To properly position the cover plate 60 with regard to the anchor bar 22, the anchor bar 22 also includes a spacer 86 extending perpendicularly from the anchor bar 22 opposite the sealing flange 28 and that engages the interior surface of the wide section 64 of the cover plate 60. The spacer 86 is formed of a generally rigid material and can be formed separately from the anchor bar 22, as shown in FIG. 1. The spacer 86 is generally L-shaped, including an attachment leg 88 having a number of openings 90 therein that are alignable with the apertures 36 and the anchor bar 22, and an engagement leg 92 extending outwardly from the anchor bar 22. Alternatively, the spacer 86 can be integrally formed with the anchor bar as shown in the second embodiment of the assembly 10 illustrated in FIG. 3 such that the spacer 86 is formed only of the engagement leg 92 extending outwardly from the anchor bar 72.

In order to secure the cover plate 60 to the anchor bar 22 and anchor cleat 46, initially the engagement flange 68 is positioned around the securing end 50 of the anchor cleat 46. Then the cover plate 60 is pivoted upwardly to engage the wide portion 64 with the spacer 86 and the locking tab 66 on the narrow section 62 with the groove 30 on the engagement portion 24.

In order to allow for gaps between adjacent parts of the system 10 to enable the system 10 to be adjusted in length as necessary to accommodate the overall length of a particular wall 14 on a building 12, the system 10 also includes a number of splice plates 94. The splice plates 94 are generally L-shaped in cross-section and formed of a material similar to the cover plate 60, and include a narrow horizontal section 96 and a wide vertical section 98. The dimensions of the narrow section 96 and wide section 98 are slightly less than the narrow section 62 and wide section 64 of the cover plate 60 such that the splice plate 94 can be inserted beneath adjacent cover plates 60 to cover the gaps between adjacent cover plates 60.

A third embodiment of the roof edge assembly of the present invention is indicated generally at 120 in FIG. 5. In this embodiment, the assembly 120 is a coping assembly that is positioned on a wall 122 having a roof edge 124 including a wooden nailer 126.

The coping assembly 120 includes an anchor clip 128 that is positioned over the wooden nailer 126 in order to fix a roofing membrane (not shown) between the anchor clip 128 and the wooden nailer 126 in order to provide a waterproof seal for the roof edge 124. The anchor clip 128 includes a central portion 130 that extends across or over the wooden nailer 126, a first vertical portion 132 positioned adjacent an interior surface 134 of the roof edge 124, and a second vertical portion 136 positioned adjacent an exterior surface 138 of the roof edge 124. The width of the central portion 130 is sufficient to accommodate roof edges 124 having varying widths such that the coping assembly 120 can be utilized with a number of different roof edge constructions. Further, the first vertical portion 132 and second vertical portion 136 each include a securing flange 139 located opposite the central portion 130.

The anchor clip 128 is secured to the wooden nailer 126 by a pair of fasteners 140 inserted through a number of first openings 142 in the central portion 130 adjacent the interior surface 134, and a number of second openings 144 disposed on the second vertical portion 136 perpendicular to the exterior surface 138. The fasteners 140 can be any conventional mechanical fastener, but are preferably a wood screw capable of securely engaging the anchor clip 128 to the nailer 126.

The anchor clip 128 also includes a pair of spacers 146 and 148 positioned at opposite ends of the central portion 130. The first spacer 146 is disposed on the anchor clip 128 adjacent the interior surface 134 and includes a lower portion 150 positioned against the central portion 130 and having an aligning flange 152 at one end. The flange 152 is engageable with the first vertical portion 132 to properly align the spacer 146 on the central portion 130. The lower portion 150 also includes a number of openings 154 that are aligned with the first openings 142 with central portion 13 by the flange 152 to enable the fasteners 140 to be inserted through both the openings 154 and the openings 142 to secure the first spacer 146 to the anchor clip 128, and the anchor clip 128 to the nailer 126.

Opposite the aligning flange 152, the lower portion 150 of the first spacer 146 also includes a curved or bowed biasing portion 156 that extends opposite the flange 152 upwardly from the lower portion 150 and away from the nailer 126. The biasing portion 156 is connected to an upper portion 158 that, due to the operation of the biasing portion 156, can move with respect to the lower portion 150 in a manner to be described.

The second spacer 148 is disposed on the central portion 130 generally opposite the first spacer 146 and includes a securing portion 159 that is attached to the central portion 130 immediately adjacent the second vertical portion 136, and a positioning portion 160 extending upwardly and outwardly from the securing portion 159 away from the nailer 126.

A cover plate 162 is secured over the anchor clip 128 in order to obscure the clip 128 and provide an aesthetically pleasing appearance to the roof edge 124. The cover plate 162 includes a top section 164 and a pair of opposed and generally parallel side sections 166 and 168. The side section 166 is positioned parallel to the first vertical portion 132 and includes an angled securing member 170 that is engageable with the securing flange 139 at the end of the first vertical portion 132. The top section 164 is engaged by the spacers 146 and 148 to position the cover plate 162 the proper distance from the anchor clip 128. By doing so, the spacers 146 and 148 ensure that the cover plate 162 is properly positioned to also allow a securing member 170 on the side section 166 to engage the securing flange 139.

The opposite side section 168 also includes a securing member 172 that is engaged with the securing flange 135 on the second vertical portion 136. However, unlike the securing member 170, the securing member 172 is formed of a vertical flange 174 extending upwardly from one side of a channel 176 formed in a lower end 178 of the side section 168, similarly to the channel 72 disclosed in FIGS. 1–4. The channel 176 is also generally rectangular in shape and extends the length of the side section 168 of the cover plate 162. The channel 176 is dimensioned to receive a sleeve 78 therein. The sleeve 78 is identical to the sleeve 78 used in the assembly 10 and includes a base 81 secured to the channel 176 and a pair of arms 82 extending outwardly from opposite sides of the base 81 to define an open end 84 extending the length of the sleeve 78 opposite the base 81. The sleeve 78 can also be replaced by any suitable securing member, such as flexible tie straps, mounting clips, or suction cups (not shown), among others. The sleeve 78 is dimensioned to receive the lighting element 74 therein similarly to the assembly 10 shown in FIGS. 1–4.

While the above description illustrates the preferred embodiments of the present invention, other embodiments are also possible. For example, each of the components of the assemblies 10 and 120 can be formed of a generally rigid material, such as a hard plastic or metal, that enables the components to be flexed a certain extent during construction of the assemblies 10 and 120. Also, the configurations for the cover plates 60 and 162 of each assembly 10 and 120 can also be altered such that the channel 72 and lighting element 74 can be positioned at any position on the cover plates in order to provide a more effective display of the lighting element 74. For example, the channel 72 can be positioned in the center of the wide portion 64 in a specified manner to enable the lighting element 74 to illustrate a design or wording on the exposed surface of the wide portion 64.

Various alternatives are contemplated as being within the scope of the following claims particularly pointing out and distinctly claiming the subject matter regarded as the invention.

We hereby claim:

1. A lighted roof edge assembly for sealing a waterproof membrane onto a roof of a building and providing an aesthetically pleasing appearance to the periphery of a building roof, the roof having a generally horizontal upper surface and an edge defining a generally vertical surface, the rubber membrane being supported by the upper surface of the roof and a portion of the membrane extending downwardly adjacent the vertical surface of the edge of the roof, the assembly comprising:

a) at least one anchor member adapted to be attached to the vertical surface of the edge of the roof and to clamp the rubber membrane against the upper surface of the roof and against the vertical surface of the edge of the roof, the anchor member including a generally planar vertical portion adapted to engage a portion of the rubber membrane and to secure it against the vertical surface, said generally planar vertical portion positioned in adjacent facing relation to the vertical surface of the edge of the roof, the generally planar vertical portion having a generally planar rearward surface adapted to be positioned in facing relation with respect to the vertical surface of the edge of the roof from the upper surface of the roof downwardly and to secure the edge of the membrane against that vertical surface, and a rearwardly extending flange projecting from the planar rearward surface, said rearwardly extending flange being integrally and rigidly connected to said planar vertical portion, and the rearwardly extending flange including a lower surface adapted to engage a portion of the rubber membrane supported by the upper surface of the roof to hold the rubber membrane down against the upper surface of the roof, the anchor member further including an upper locking flange and a lower locking flange;

b) a cover plate releasably securable to the anchor member, the cover plate including an upper edge having means for gripping said upper locking flange and including a lower edge having means for gripping said lower locking flange, said cover plate further including an exterior surface that defines a channel; and c) a lighting assembly secured within the channel, the lighting assembly including a retainer secured to the cover plate within the channel and a lighting element releasably secured within the retainer.

2. The assembly of claim 1 wherein the anchor member includes a spacer extending between the anchor member and the cover plate.

3. The assembly of claim 2 wherein the assembly is a fascia assembly.

4. The assembly of claim 2 wherein the assembly is a coping assembly.

5. The assembly of claim 2 wherein the spacer is spring-biased.

6. The assembly of claim 2 wherein the anchor member includes a first spacer adjacent one end of the anchor member and a second spacer adjacent the opposite end.

7. The assembly of claim 1 wherein the retainer is secured to the cover plate within the channel by at least one fastener.

8. The assembly of claim 7 wherein the at least one fastener is a number of mechanical fasteners.

9. The assembly of claim 1 wherein the channel is disposed at a lower end of the cover plate.

10. The assembly of claim 1 wherein the retainer is biased to a closed position around the light element.

11. The assembly of claim 10 wherein the retainer is formed of a generally flexible material.

12. The assembly of claim 11 wherein the retainer is formed of a plastic material.

13. A method for assembling a lighted roof edge assembly for sealing a waterproof membrane onto a roof of a building and providing an aesthetically pleasing appearance to the periphery of a building roof, the roof having a generally horizontal upper surface and an edge defining a generally vertical surface, the rubber membrane being supported by the upper surface of the roof and a portion of the membrane extending downwardly adjacent the vertical surface of the edge of the roof, said method comprising the steps of:

a) selecting an anchor member adapted to clamp the rubber membrane against the upper surface of the roof and against the vertical surface of the edge of the roof, the anchor member including a generally planar vertical portion adapted to engage a portion of the rubber membrane and to secure it against the vertical surface, and the anchor member including a rearwardly extending flange adapted to engage a portion of the rubber membrane supported by the upper surface of the roof to hold the rubber membrane down against the upper surface of the roof;

b) engaging the anchor member to the roof edge so that the generally planar vertical portion is positioned in adjacent facing relation to the vertical surface of the edge of the roof to secure the edge of the membrane against that vertical surface, and so that the rearwardly extending flange of the anchor member is positioned to engage a portion of the rubber membrane supported by the upper surface of the roof to hold the rubber membrane down against the upper surface of the roof;

c) selecting a cover plate, said cover plate including an exterior surface that defines a channel for a lighting retainer;

d) securing the cover plate to the anchor member; and e) engaging a lighting element with the lighting retainer.

14. The method of claim 13 wherein the step of engaging the light element with the retainer comprises the steps of:

a) placing the lighting element against the retainer; and b) pressing the lighting element into the retainer.

15. The method of claim 14 further comprising the step of removing the lighting element from the retainer after pressing the lighting element into the retainer.

16. The method of claim 13 wherein the step of securing the cover plate to the anchor member comprises the steps of:

a) placing the retainer against the cover plate;

b) securing the retainer to the cover plate; and c) engaging the cover plate with the anchor member.

17. The method of claim 16 wherein the step of securing the retainer to the cover plate comprises engaging a fastener between the retainer and the cover plate.

18. A lighted roof edge assembly for sealing a waterproof membrane onto a roof of a building and providing an aesthetically pleasing appearance to the periphery of a building roof, the roof having a generally horizontal upper surface and an edge defining a generally vertical surface, the rubber membrane being supported by the upper surface of the roof and a portion of the membrane extending downwardly adjacent the vertical surface of the edge of the roof, the assembly comprising:

a) an anchor member having a first end and a second end and attachable using a fastener to the vertical surface of the edge of the roof, the first end of the anchor member including a generally planar vertical portion adapted to engage a portion of the rubber membrane and to secure it against the vertical surface, and the second end of the anchor member including a rearwardly extending flange adapted to engage a portion of the rubber membrane supported by the upper surface of the roof to hold the rubber membrane down against the upper surface of the roof;

b) a cover plate having first engagement flange at one end that is engageable with the first end of the anchor member, and a second engagement flange at the opposite end that is engageable with the second end of the anchor member, the cover member further including a channel therein; and c) a lighting assembly positioned within the channel, the lighting assembly having at least one retainer secured to the cover plate within the channel and a lighting element releasably secured to the retainer.

19. The assembly of claim 18 wherein the anchor member is comprised of an anchor bar secured to the roof, and an anchor cleat secured to and extending downwardly from the anchor bar.

20. The assembly of claim 18 wherein the anchor member includes at least one spacer extending from an outer surface of the anchor member to an inner surface of the cover member for providing a space between the anchor member and cover member.

* * * * *